United States Patent [19]

Osaka et al.

[11] Patent Number: 4,607,954

[45] Date of Patent: Aug. 26, 1986

[54] AUTOMATIC DEVELOPING BIAS CONTROL DEVICE

[75] Inventors: Haruya Osaka, Osaka; Hiroshi Kimura, Habikino; Masahiko Hisajima, Osaka; Yutaka Shigemura, Takarazuka; Seiji Kaminaga, Matsudo; Shinobu Satonaka, Toyonaka; Mitsuya Ishito, Sakai, all of Japan

[73] Assignee: Mita Kogyo Kabushiki Kaisha, Japan

[21] Appl. No.: 582,683

[22] Filed: Feb. 23, 1984

[30] Foreign Application Priority Data

Feb. 26, 1983 [JP] Japan ..... 58-31235

[51] Int. Cl.[4] ..... G03G 15/09; G03G 21/00

[52] U.S. Cl. ..... 355/14 D; 355/3 R

[58] Field of Search ..... 355/3 R, 14 D, 14 E

[56] References Cited

U.S. PATENT DOCUMENTS 3,877,413 4/1975 Rowell et al. ..... 355/14 D X
3,918,395 11/1975 Fearnside ..... 118/8
4,153,364 5/1979 Suzuki et al. ..... 355/14 E
4,239,374 12/1980 Tatsumi et al. ..... 355/14 D X

FOREIGN PATENT DOCUMENTS 57-76562 5/1982 Japan .
57-172365 10/1982 Japan .

*Primary Examiner*—Fred L. Braun
*Attorney, Agent, or Firm*—Beveridge, DeGrandi & Weilacher

[57] ABSTRACT

An automatic developing bias control device for an electrophotographic copying machine in which a document image is led onto a photoreceptor through a lens to form an electrostatic latent image on the photoreceptor and the electrostatic latent image is visualized into a toner image by a developing device, the automatic developing bias control device operating on the principle of detecting the density of the document image by a detecting element disposed inside or outside the optical path, delaying the output detection signal for a predetermined time, and imposing a developing bias potential corresponding to the delayed output detection signal on the developing device to thereby provide copy image quality faithful to the original.

4 Claims, 3 Drawing Figures

AUTOMATIC DEVELOPING BIAS CONTROL DEVICE

BACKGROUND OF THE INVENTION

This invention relates to an automatic developing bias control device for use with an electrophotographic copying machine and more particularly it relates to an automatic developing bias control device for an electrophotographic copying machine in which a document image is led onto a photoreceptor through a lens to form an electrostatic latent image on the photoreceptor and the electrostatic latent image is visualized into a toner image by a developing device, said automatic developing bias control device operating on the principle of detecting the density of the document image, and setting the developing bias potential which is to be present during development of said document image so that said potential corresponds to said output detection signal.

Conventionally, because of the need to provide optimum copy image quality with respect to a variety of documents, the operator visually judges the print density of the document and manipulates the density control knob installed in the operating section so as to change the amount of exposure or the bias potential of the developing device to thereby adjust the print density of the copy.

In the aforesaid method relying on the operator's visual judgment, however, the operating characteristics are unsatisfactory or visual judgment varies from one operator to another, resulting in a problem that copies having optimum image quality cannot always be produced.

Therefore, in recent years, there has been adopted a system in which the intensity of light reflected from the original is detected and the resulting output detection signal is used to control the amount of exposure of the original or a second system in which the bias potential of the developing device is automatically controlled.

In the former system, which is disclosed for example in U.S. Pat. Nos. 3,279,312, 3,609,038, and 3,914,049, since the response of the light source is poor, it is impossible to control the amount of exposure in an instantaneous manner based on image information obtained by exposing the original. Further, it may be contemplated to control the amount of light reflected from the original by means of a shutter mechanism U.S. Pat. No. 3,438,704), but in this case also there is the same drawback as that described above since the response of the shutter mechanism, which is mechanically driven, is poor.

On the other hand, the latter system is superior, involving no problems inherent in the preceding systems, because of its high response with which the bias potential of the developing device is changed. U.S. Pat. No. 4,304,486 discloses a copying machine based on such system, wherein a light detector receives the non-condensed portion of the reflected light to detect the light intensity, and a bias potential determined by the detected intensity is applied to the developing device. With such a copying machine, the intensity of reflected light from each document is detected to control the bias potential of the developing device, so that copies having optimum copy image quality can be obtained.

However, this technique is applicable only when the document image information does not vary with the exposure travel direction (the direction in which the document support platen or the optical system travels for slit exposure purposes) so that the document can be judged te be light or dark as a whole. Even if it is applied to a document having such variation dependent on the exposure travel direction, it is impossible to obtain a copy having optimum image quality. That is, where it is applied to a document having such variation, there has been a problem that a copy having erroneously controlled image quality is produced, such as a copy in which some portions have optimum copy image quality and others do not, or a copy in which all portions deviate from the level of optimum copy image quality.

An object of this invention is to provide a novel automatic developing bias control device for an electrophotographic copying machine which is designed to detect image information from every exposed portion of a document during exposure travel and to set the bias potential of the developing device, which is present at the instant of developing each of said image information portions, at the proper value so that it corresponds to the output detection signal.

This invention comprises scanning and exposing means for scanning and exposing a document, detecting means for detecting the amount of light reflected from the document, delaying means for delaying the output detection signal for a period of time dependent on the time taken for the electrostatic latent image of the document to travel from the position of formation of the latent image by the scanning and exposing operation to the position of image visualization by the developing device, and control means for changing the bias potential of the developing device so that it corresponds to the output from the delaying circuit.

As for the detecting means, at least one such means is provided inside or outside the optical path, it being only necessary that the means be capable of detecting the amount of reflected light by the reflected light itself or by disturbance light. It is disposed at a position remote from the document image forming postion, for example, in the vicinity of the lens or upstream or downstream of the lens, so as not to produce adverse effects on the formation of images on the photoreceptor surface.

The control means includes means for changing the bias potential continuously with respect to the delayed output and also means for changing it stepwise.

DESCRIPTION OF THE PEFERRED EMBODIMENT

Figure 1:
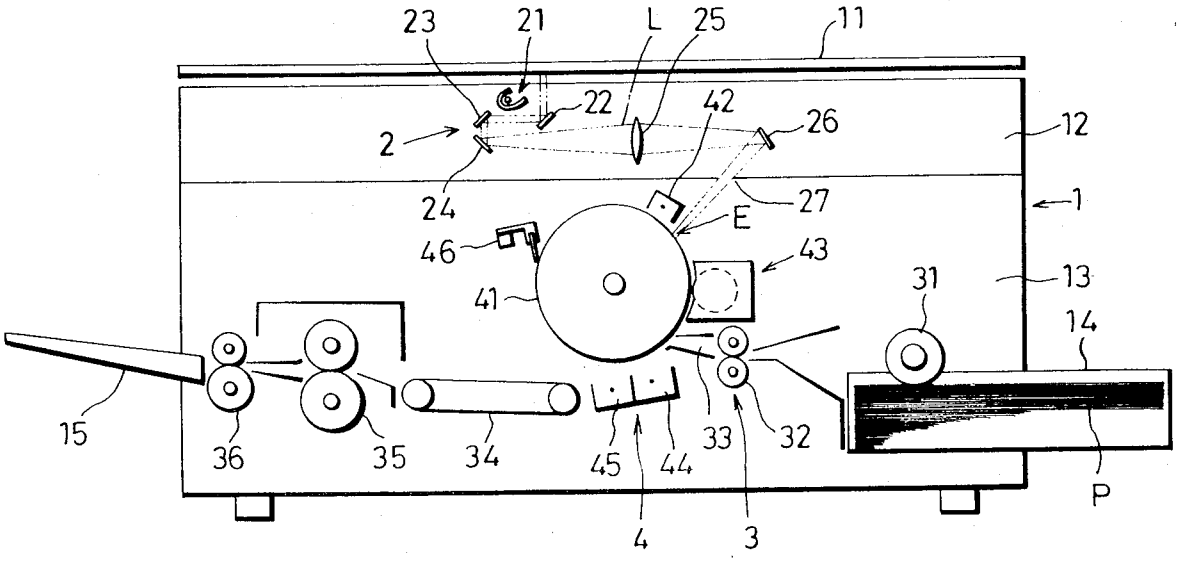
FIG. 1 is a schematic view of an electrophotographic copying machine.

FIG. 1 shows the internal mechanism of a typical electrophotographic copying machine, wherein a copying machine main body 1, having on the top a document support platen 11, is internally divided into upper and lower chambers 12 and 13, with the upper chamber 12 containing an optical system 2, for exposing a document, and the lower chamber 13 containing a paper feed line 3, for conveying copying paper sheets, and a copy processing device 4.

Figure 2:
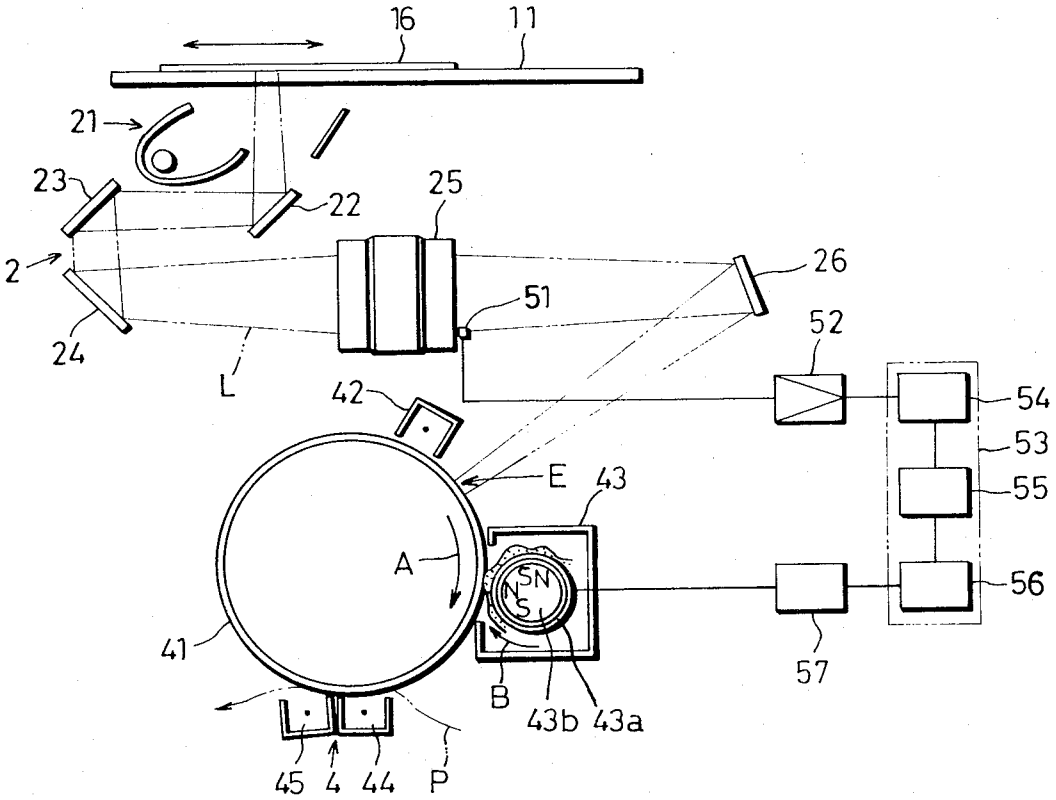
FIG. 2 is an explanatory view showing the relevant portion of the copying machine.

The optical system 2, as shown also in FIG. 2, comprises a light source 21 for illuminating a document 16 placed on the document support platen 11, reflecting mirrors 22, 23, and 24 for leading the reflected light from the document to a lens 25, and a reflecting mirror 26 for leading the light transmitted by the lens 25, through a slit 27, onto a photoreceptor drum 41 for image formation. The paper feed line 3 comprises a paper feed roller 31 for primary paper feed, resist rollers 32 for secondary paper feed in synchronism with the photoreceptor drum 41, heating and fixing rollers 35, and delivery rollers 36, the arrangement being such that copying paper sheets P are fed one by one from a paper feed cassette 14 to the copy processing device 4, and a copying paper sheet P receives a toner image in the copy processing device 4 and is subjected to a heating and fixing treatment, whereupon it is discharged onto a receiving tray 15.

The copy processing device 4 has the photoreceptor drum 41, which has a photoreceptor layer on its outer surface and is adapted to be rotated in the direction of arrow A (FIG. 2) in synchronism with the scanning and exposure of the document. A corona discharger 42 for uniformly charging the photoreceptor layer, a developing device 43 for attracting toner to an electrostatic latent image corresponding to the document image to thereby visualize the latent image into a toner image, a transfer corona discharger 44 for transferring the toner image to the copying paper sheet P, a separation corona discharger 45 for peeling the copying paper sheet P from the photoreceptor drum 41, and a cleaner 46 for recovering the remaining toner are arranged in the order mentioned around the periphery of the photoreceptor drum 41. Thus, as the transparent document support platen 11 is horizontally moved, the document 16 is slit-exposed to the light from the light source 21, and as the document image travels in the optical path L, it is reflected successively by the reflecting mirrors 22, 23, and 24 and then passes through the lens 25 and is reflected by the reflecting mirror 26 and passes through the slit 27 to reach the cylindrical photoreceptor layer on the outer surface of the photoreceptor drum 41. Since the phtoreceptor drum 41 is driven for rotation in the direction of arrow A, the photoreceptor layer is uniformly charged by the corona discharger 42, and in an exposure region E there is formed an electrostatic latent image corresponding to the document image reaching region E as described above, said electrostatic latent image being then visualized into a toner image at the developing device 43. Thus, to visualize the electrostatic latent image formed on the photoreceptor layer, the developing device 43 comprises a developing sleeve **43*a*, driven for rotation in the direction of arrow B, and a stationary permanent magnet 43*b*, the arrangement being such that the toner is conveyed in the direction of arrow B by a magnetic brush formed of the developing sleeve 43*a* and stationary permanent magnet 43*b*, whereby the electrostatic latent image formed on the photoreceptor is visualized into a toner image. The toner image is then transferred from the photoreceptor layer surface to the copying paper sheet P by the transfer corona discharger 44, and the copying paper sheet P is peeled from the photoreceptor drum 41 by the separation corona discharger 45 disposed downstream of the transfer corona discharger 44 as viewed in the direction of copying paper sheet conveyance. The copying paper sheet is then conveyed by the copying paper sheet conveyor 34 to the heating and fixing rollers 35, where the toner image is fixed, and finally the sheet is discharged onto the tray 15 by the delivery rollers 36**. The foregoing refers to a typical example of an electrophotographic copying machine, but as will become apparent from the following description, the invention is applicable, besides this, to other known electrophotographic copying machines, such as one designed to move the optical system to effect slit exposure, and another wherein the photoreceptor layer is formed not on a photoreceptor drum but on a photoreceptor belt.

The automatic developing bias control device of this invention comprises a detecting element 51 disposed adjacent the lens 25, a delaying circuit 53 for delaying the output signal from the detecting element 51, and a control circuit 57 for changing the bias potential to be imposed on the developing sleeve **43*a* correspondingly to the output signal from the delaying circuit 53. Preferably, the output signal from the detecting element 51 is amplified by an amplifying circuit 52 before it is imposed on the delaying circuit 53**.

Figure 3:
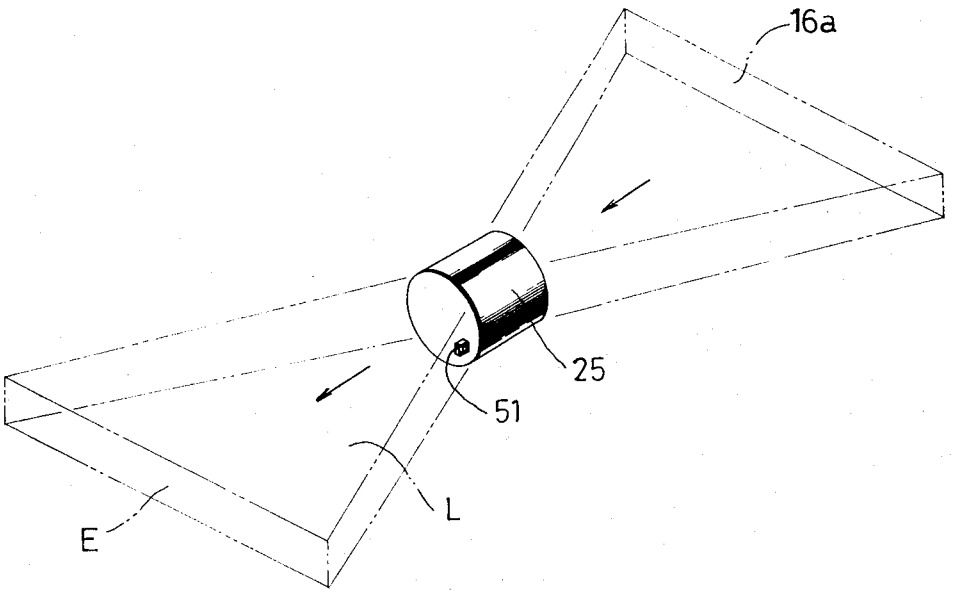
FIG. 3 is a sketch showing an optical path in which a document image is formed on a photoreceptor.

To describe in more detail, as shown in FIG. 3, the light reflected from a portion **16*a* of the document 16 is condensed by the lens 25 to form an image at the exposure position E on the photoreceptor drum 41. The detecting element 51 for detecting the density of the document image is disposed downstream of and close to the lens 25 in the optical path L and adapted to produce an electric signal corresponding to the amount of light received; said element may be a photodiode. In the vicinity of the lens in the optical path, since the document image is constricted, the average density of the document image in the direction of the width (the direction perpendicular to the paper of FIG. 2) can be easily detected by the detecting element 51 which is relatively small in size. Further, the formation of images at the exposure position E on the photoreceptor drum 41 is little influenced by the detecting element 51 disposed close to the lens 25** and there is no danger of the formed image becoming obscure.

The position of installation of the detecting element 51 may be upstream or downstream of the lens 25, but if it is upstream, the amount of exposure is not uniform, sometimes making it necessary to provide a compensaton plate (not shown) for ensuring that the amount of exposure is uniform. On the other hand, if it is downstream, this is desirable, requiring no compensation plate. Although it is not absolutely necessary that the detecting element be positioned close to the lens 25, the position should be such that it produces no adverse effect on the formation of images at the exposure position E on the photoreceptor drum 41. Further, the detecting element 51 may be disposed inside the optical path L or it may be disposed outside the optical path L so as to receive disturbance light. Only a single detecting element 51 may be used, but it is possible to use a plurality of such detecting elements arranged side by side so as to detect the density of the document image more accurately. The electric signal from the detecting element 51, which represents the average density of the document image, is amplified by the amplifying circuit 52 and imposed on the delaying circuit 53. The delaying circuit 53 comprises a low pass filter 54, a bucket brigade device 55, and a low pass filter 56, and is adapted to delay the electric signal from the amplifying circuit 52. The delay time may be set either to the time W1 taken for the portion of the photoreceptor drum 41 exposed in the exposure region E to travel in the direction of arrow A until it reaches the position where it contacts the magnetic brush of the developing device 43, i.e., the position where the electrostatic latent image corresponding to the document is visualized, or the time W1–W2 which compensates the time W1 for the delay operation time W2 taken to impose the bias potential. By setting it to the time W1–W2, it is possible to change the bias potential with optimum time (at the very point of time when the portion of th document image having its density detected is developed), which is desirable, but the operation delay time W2 is so small that even if it is set to the time W1, the bias potential can be changed with timing which is not actually inconvenient. The delayed signal from the delaying circuit 53 is applied to the control circuit 57, and the bias potential is controlled by the control circuit so that it is lower as the color of the document image becomes lighter, whereby the bias potential to be imposed on the developing sleeve 43*a* of the developing device 43 is changed according to the density of the document image. The change in the bias potential by the control circuit 57 may be continuous or stepwise, but a continuous change is desirable since this makes it possible to provide a bias potential which more faithfully corresponds to the density of the document image.

As is clear from the foregoing description, the automatic developing bias control device of this invention constantly detects the density of a document image with the detecting element during copying operation and delays the output detection signal for a time associated with the time taken for the image to travel from the position at which it is formed by scanning and exposing operation to the position at which it is visualized or developed by the developing device, thereby making it possible to apply a bias potential in conformity with the density of the document image so as to provide a copy image which is faithful to each portion of the document.

This invention is not limited to the embodiment described above and changes and modifications may, of course, be made within the scope of the invention.

What is claimed is:

1. An automatic developing bias control device for an electrophotographic copying machine in which a document image is directed along a path through a lens onto a phtoreceptor to form an electrostatic latent image on the photoreceptor and the electrostatic latent image is developed into a toner image by a developing device which produces a developing bias that is changed in accordance with the density of the document image, said automatic developing bias control device comprising a photoelectric converting device within the image path and adjacent the lens for detecting the document image and generating an electric signal corresponding to the density thereof; delaying means comprising a first low pass filter, a bucket brigade device, and a second low pass filter, for delaying the electric signal from the photoelectric converting device for a time associated with the time taken for the electrostatic latent image to travel from the position at which said latent image is formed to the position at which said latent image is developed by the developing device; and control means responsive to the output from the delaying means for adjusting the developing bias of the developing device to control the density of the toner image.

2. An automatic developing bias control device as set forth in claim 1, wherein the photoelectric converting device is disposed downstream of the lens.

3. An automatic developing bias control device as set forth in claim 1, wherein delaying means delays the electric signal for a time equal to the time required for the electrostatic latent image to travel from the position at which said latent image is formed to the position at which said latent image is developed compensated by the operation delay time required for the application of the developing bias.

4. An automatic developing bias control device as set forth in claim 1, wherein the control means is adapted to continuously change the developing bias in accordance with the density of the document image.

* * * * *